United States Patent [19]

Seremet

[11] Patent Number: 4,535,612

[45] Date of Patent: Aug. 20, 1985

[54] PADLOCK SHIELD

[76] Inventor: Louis J. Seremet, Rural Box 44, Brookfield, Mass. 01506

[21] Appl. No.: 483,245

[22] Filed: Apr. 8, 1983

[51] Int. Cl.[3] ..... E05B 67/38

[52] U.S. Cl. ..... 70/56

[58] Field of Search ..... 70/56, 54, 55, 417, 70/2, 6, 7–12; 292/281

[56] References Cited

U.S. PATENT DOCUMENTS

| | | | |
|---|---|---|---|
| 3,590,607 | 7/1971 | Beaver | 70/56 |
| 3,718,014 | 2/1973 | Delgadillo | 70/56 |
| 4,300,369 | 11/1981 | Besecker | 70/56 |

FOREIGN PATENT DOCUMENTS

| | | | |
|---|---|---|---|
| 1905014 | 8/1970 | Fed. Rep. of Germany | 70/56 |

*Primary Examiner*—Robert L. Wolfe

*Attorney, Agent, or Firm*—Blodgett & Blodgett

[57] ABSTRACT

A shielded lock assembly for a padlock for securing a pair of closure members and comprising a staple secured to one closure member and a hasp secured to the other closure member. The hasp has a back plate for securing the hasp to the closure member and a front plate hingedly connected to the back plate for movement to a closed position in which the front plate overlies the staple, the front plate having a slot for receiving the loop portion of the staple and a tubular shield which circumscribes the slot and extends outwardly from the front plate at an angle to an open end which allows the insertion of a human hand into the shield for application of a padlock to the staple to secure the hasp in the closed position and to permit subsequent unlocking of the padlock.

11 Claims, 10 Drawing Figures

PADLOCK SHIELD

BACKGROUND OF THE INVENTION

The present invention is generally directed to a lock for closure members and specifically directed to a guarded padlock to prevent vandalism and theft and to protect the padlock from the weather elements. Padlocks are generally used to secure closure members, such as tool boxes and the doors of trucks and buildings, and for many other applications. The railroad industry, in particular, uses padlocks extensively in critical areas that are remote or otherwise difficult to patrol, such as railroad switches, boxcar doors, etc. Padlocks are used in combination with lock assemblies which include a staple which is secured to a first closure member and a hasp which is secured to a second closure member. The staple has a loop portion which extends beyond the outer face of the first closure member. The hasp consists of a back plate which is secured to the second closure member and a front plate which is hingedly connected to the back plate and includes a slot which is adapted to slip over the loop portion of the staple, so that the loop extends beyond the outer surface of the front plate. The shackle portion of the padlock is inserted through the loop and secured within the body portion of the padlock.

The padlocks, however, do not always affectively serve their intended purpose as they can be readily disabled by a determined vandal or thief. For example, a sharp blow to the body portion of the padlock can dislodge the shackle from the body. Also, a bar may be inserted within the shackle and utilized as a lever to break or pry the shackle from the body of the padlock. The exposed padlock is also subject to rust and corrosion from the weather elements and the lock may freeze-up when moisture enters the keyhole and subsequently freezes.

Several types of guards or shields have been developed for protecting a padlock from the weather elements and from vandalism and theft. These shields have not been generally accepted for a variety of reasons. The prior art shields are generally complicated and difficult to install, so that the resulting cost of the entire lock assembly is very often prohibitive for most applications.

The main objection with prior art shields is that they make it very difficult to lock and unlock the padlock which they protect. In order to be effective against vandalism, most prior art shields have access openings which are spaced considerably from the padlock to permit entry of the human hand but to prevent the insertion of a disabling tool. The shielded padlock cannot be locked and unlocked by an individual while he or she faces the lock. The individual must position his or her shoulder or back against one of the closure members in order to reach the padlock through the opening of the shield. This is particularly difficult to do if the access opening is at the bottom position which is the best place to be for protection of the padlock against the weather elements. These and other difficulties experienced with the prior art devices have been obviated by the present invention.

It is, therefore, an outstanding object of the invention to provide a padlock lock assembly having shield means for protecting the padlock against the weather elements and from vandalism and theft while permitting easy access to the padlock for authorized use.

Another object of the invention is the provision of a shielded lock assembly for a padlock which is simple in construction, and can be manufactured inexpensively without the use of special tools.

A further object of the present invention is the provision of a shielded lock assembly for a padlock which is extremely easy to install.

It is another object of the instant invention to provide a shielded lock assembly for a padlock which is capable of a long life of useful service with a minimum of maintenance.

A still further object of the invention is the provision of a shielded hasp which can be easily applied to existing padlock lock assemblies.

With these and other objects in view, as will be apparent to those skilled in the art, the invention resides in the combination of parts set forth in the specification and covered by the claims appended hereto.

SUMMARY OF THE INVENTION

In general, the invention consists of a hasp for a padlock lock assembly, comprising a back plate and having a slot for receiving the loop portion of a padlock staple, and a tubular shield which extends at an angle from the front plate to an access opening spaced from the plate. The back plate is adapted to be secured to a flat supporting surface and the tubular shield circumscribes the slot where it is attached to the front plate. The invention also consists of a lock assembly for securing first and second closure members in which the shielded hasp is used in combination with a staple which is secured to one of the closure members. The back plate of the hasp is secured to the other closure member so that the front plate can pivot about the hinged connection with the back plate to a closed position in which the loop portion of the staple extends through the slot of the front plate for receiving the shackle portion of a padlock.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
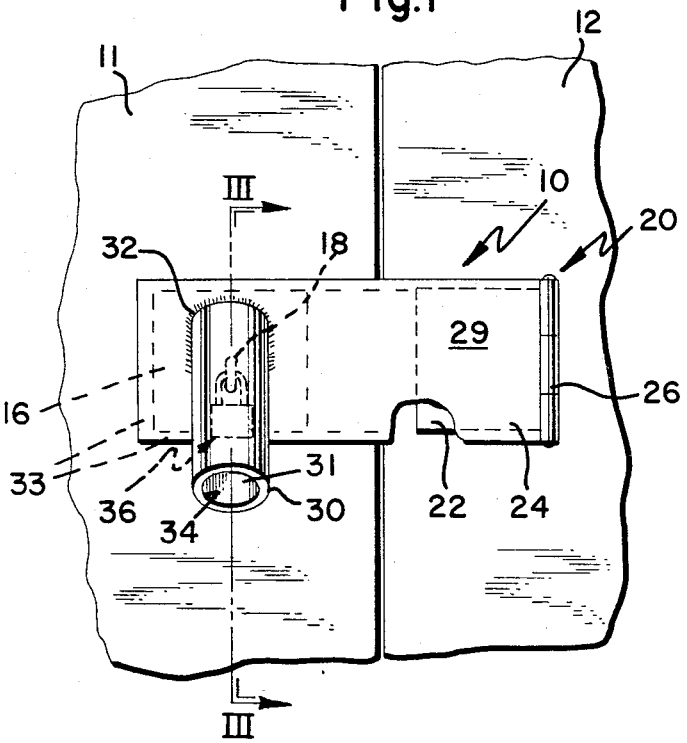
FIG. 1 is a front elevational view of the shielded lock assembly shown applied to a pair of closure members in the closed and locked position.
Figure 3:
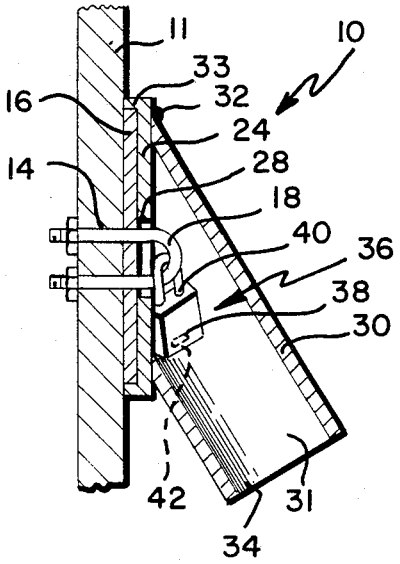
FIG. 3 is a vertical cross-sectional view of the lock assembly taken on the line III—III of FIG. 1.
Figure 2:
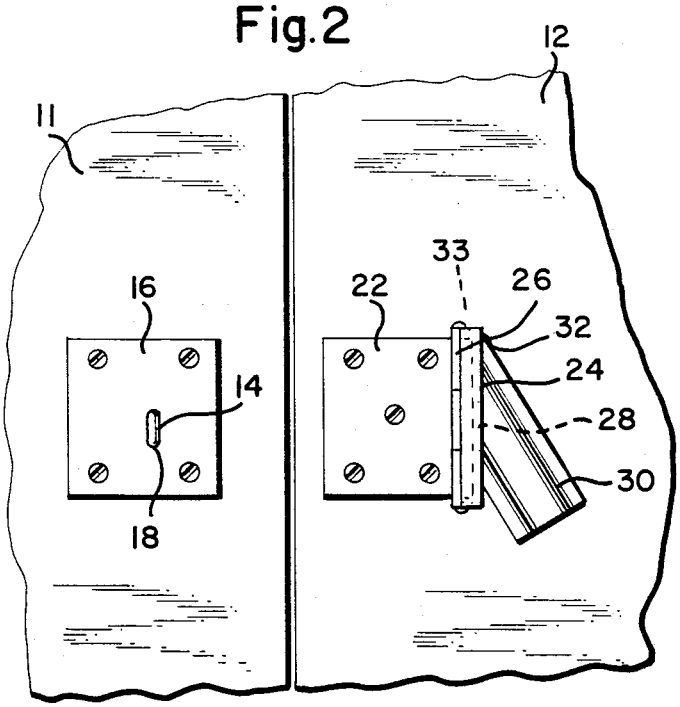
FIG. 2 is a front elevational view showing the shielded lock assembly in the open or unlatched position.

Referring to FIGS. 1–3, the shielded lock assembly of the present invention is generally indicated by the reference numeral 10 and is shown applied to first and second closure members 11 and 12, respectively. The closure members 11 and 12 may consist of a pair of doors, such as at the back of a truck or one of the closure members may be a fixed structure and the other closure member a door which is movable relative to the fixed closure member.

Figure 4:
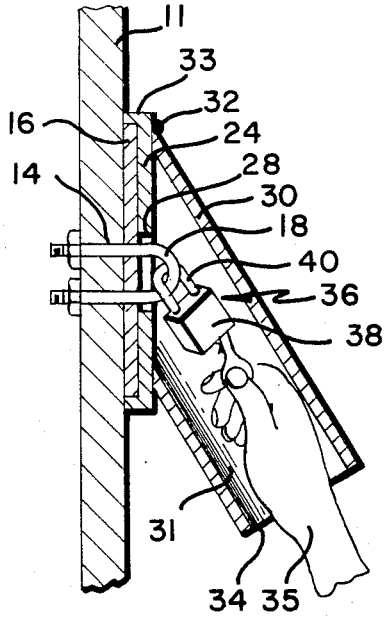
FIG. 4 is a view similar to FIG. 3 illustrating the application of a key to the padlock which is located within the shielded portion of a lock assembly.
Figure 5:
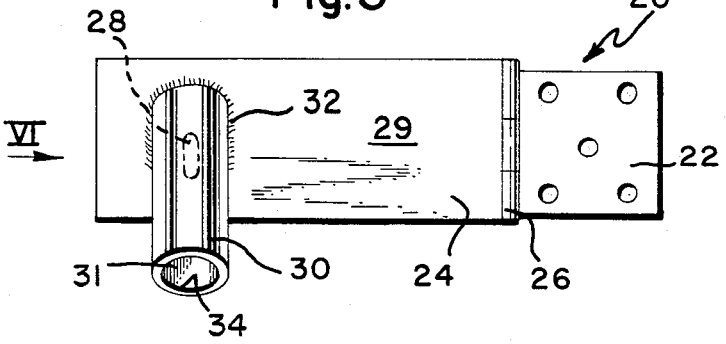
FIG. 5 is a front elevational view of the shielded hasp of the present invention.
Figure 6:
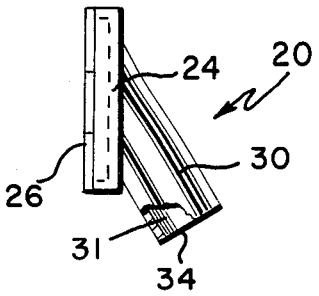
FIG. 6 is an end view of the hasp looking in direction of arrow VI—VI of FIG. 5.
Figure 7:
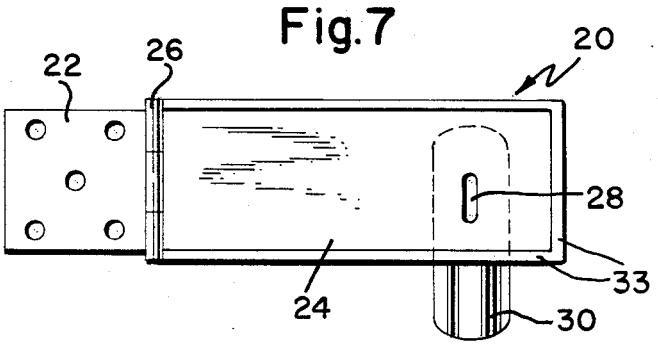
FIG. 7 is a rear elevational view of the shielded hasp.

The lock assembly 10 comprises a staple 14 which is secured to the first closure member 11 in a conventional manner so that the loop portion 18 of the staple extends beyond the forward surface of the closure member. Preferably, the staple 14 also extends beyond a face plate 16 which is secured to the forward face of the closure member 11. The lock assembly 10 also includes a hasp generally indicated by the reference numeral 20. The hasp 20 comprises a back plate 22 adapted to be secured to the second closure member 12 and a front plate 24 which is pivotally connected to the back plate 22 by means of a hinge 26. The front plate 24 has a slot 28 which is spaced sufficiently from the hinge 26 so that when the front plate 24 is in the closed position, as shown in FIG. 1, the loop portion 18 of the staple extends through the slot 28, see particularly FIG. 3. One end of a tubular shield 30 is fixed to the forward face surface 29 of the front plate 24, as for example by a weld 32 and completely circumscribed the slot 28. The opposite end of the shield 30 has an access opening 34 which is large enough to permit the insertion of an adult human hand 35, as shown in FIG. 4. The shield 30 is preferably cylindrical and defines a cylindrical cavity 31. The central longitudinal axis of the cavity 31 extends from the forward face surface 29 of the front plate at a substantial angle, so that the access opening 34 is located at a considerable distance from the closure member 11, as shown in FIG. 3.

The front plate is preferably provided with a lip 33 at the periphery so disposed that when the hasp assembly is in locked position the lip covers the edges of the back plate 22 and face plate 16. This discourages the insertion of a thin, hacksaw-type blade into the assembly to cut the lock parts.

When the hasp 20 is in the closed or latched position as shown in FIGS. 1 and 3, it is ready to receive the padlock. The padlock is generally indicated by the reference numeral 36 and includes a body portion 38 which contains a keyhole 42 at one end and a shackle 40 at the opposite end. The shackle 40 is adapted to extend through the loop 18 as shown in FIG. 3 to secure the front plate 24 of the hasp 20 in the closed position.

The operation and advantages of the present invention will now be readily understood in view of the above description. A lock assembly 10 is applied to the closure members 11 and 12 by first securing the staple 14 to the closure member 11 in any conventional manner, so that the loop 18 extends beyond the forward surface of the closure member or beyond the face plate 16 if one is used. The hasp 20 is applied by securing the back plate 22 to the second closure member 12 so that the front plate 24 can swing from the open position shown in FIG. 2 to the closed position shown in FIG. 1, so that the slot 28 slips over the loop 18. With the hasp 20 in the closed position, the padlock 36 is applied to the loop 18. The opened shackle 40 is inserted through the loop 18 and the free end of the shackle is inserted into the body 38 to the closed or locked position. The hasp 20 is now securely locked in the latched or closed position and the padlock 36 is fully protected from the weather elements and from vandalism by the shield 30. The length of the shield 31 is sufficient to prevent a disabling tool from effectively reaching the padlock 36 and yet the padlock can be easily reached for unlocking by an authorized person. As shown in FIG. 4, an authorized individual with the proper key can open the padlock 36 by inserting his or her hand through the access opening 34 so that the hand extends into the cavity 31 to a point beyond the wrist joint. The key is inserted into the keyhole 42 of the body portion 38 and then the body portion 38 is grasped by the hand and pulled downwardly to release the shackle 40 from its closed position within the body 38. Since the axis opening 34 extends away from the closure members, locking and unlocking the padlock 36 can be accomplished quite easily by the authorized individual while standing in a normal position directly in front of the lock. The padlock cannot, however, be reached with both hands simultaneously. This effectively discourages lock-picking activity which generally requires two-handed manipulations.

In highly critical applications where a determined assault on the security of a closure is expected, the elements of the hasp are preferably embodied in metal of about $\frac{1}{4}$ inch thickness and case hardened to a depth of about 20 thousandths of an inch. Such material is nearly indestructible to the ordinary tools of vandal and thief. As a further protection the tubular shield may be formed of stainless tubing by known methods. This eliminates the longitudinal weld which might otherwise represent a weak spot in the shield.

Figure 8:
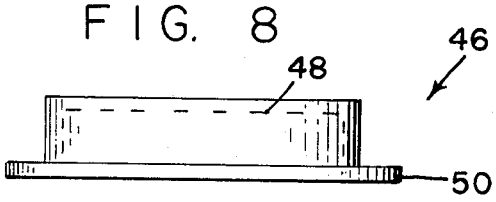
FIG. 8 is an elevational view of a cap for the shield opening.
Figure 9:
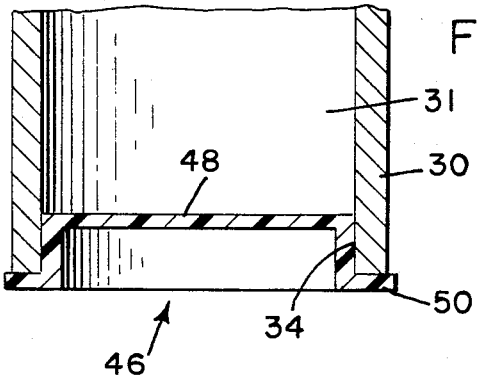
FIG. 9 is a fragmentary cross-sectional view of the shield opening with the cap in place.

For certain applications where there is apt to be upward splashing of water, such as the rear door of a truck, it is preferred that the opening 31 of the shield 30 be sealed against moisture. This is accomplished by a cap 46, see FIGS. 8 and 9. The cap 46 includes a cylindrical main body portion 48 which fits snugly into the opening 34. The cap 46 also includes an annular flange 50 which extends outwardly from the main body portion 48. When the cap is inserted into the opening 34 as shown in FIG. 9, the flange 50 limits the insertion of the cap 46 into the opening 34 and extends beyond the wall of the shield 30 to provide a finger grip for removal of the cap. It is also preferred that the cap be constructed of a thermoplastic material such as polyethylene.

Figure 10:
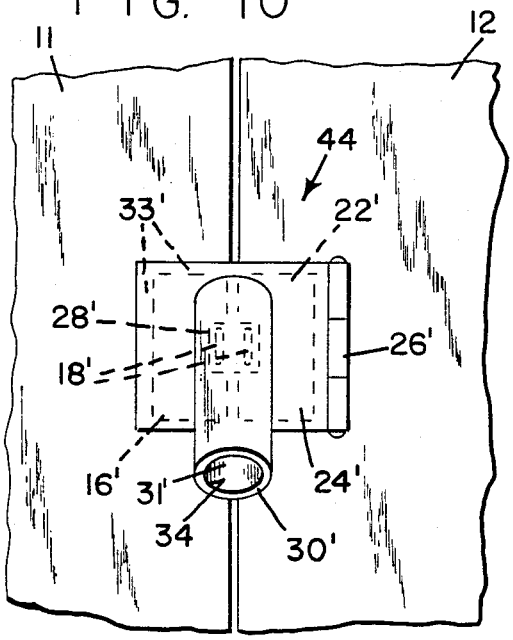
FIG. 10 is a view similar to FIG. 1 showing a modification.

Referring to FIG. 10, there is shown a modified lock assembly, generally indicated by the reference numeral 44. The elements of the assembly 44 are similar to those of the lock assembly 10 including a face plate 16', a back plate 22', a front plate 24' and a tubular shield 30'. The plates 16' and 22' are attached to the closure members 11 and 12, respectively. Each of the plates 16' and 22' has a loop 18' extending outwardly adjacent the juncture of the closure members. The front plate 24' is pivotally connected to the back plate 22' by a hinge 26' and contains an enlarged slot 28'. The slot 28' opens into cavity 31' of the shield 30' in the same manner as the preferred embodiment as illustrated in FIG. 3. When the plate 24' is swung to the closed position as shown in FIG. 10, both of the loops 18' extend through the slot 28' and into the cavity 31'. A padlock is inserted into the cavity 31' through opening 34' and the shackle portion of the padlock is inserted through both loops 18' and snapped into the body portion of the padlock to complete the locking operation.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to be secured by Letters Patent is:

1. Lock assembly for securing first and second closure members, comprising:

(a) a staple secured to one of said closure members and having a padlock receiving loop, (b) a hasp having a back plate secured to the other of said closure members, and a front plate hingedly connected to the back plate for movement from an open position in which the front plate is clear of said one closure member to a closed position in which the front plate overlies said loop, said front plate having a slot for receiving the loop of said staple so that loop extends forwardly of the outwardly facing surface of the front plate when the front plate is in said closed position, (c) a padlock having a body portion, a shackle at one end of the body portion, and a keyhole at the other end of the body portion, said shackle being adapted to extend through the loop portion of said staple to secure the front plate of said hasp in said closed position, and (d) a tubular shield having an inner end which is fixed to said outwardly facing surface and which completely circumscribes said slot, said shield having an outer end which has an opening that is large enough to permit the insertion of a human hand, said tubular shield defining a cavity having a central longitudinal axis which extends at a substantial angle to the plane of said outwardly facing surface, said tubular shield being sufficiently long so that an adult human hand must be inserted beyond the wrist joint in order to reach the padlock.

2. Lock assembly as recited in claim 1, wherein said tubular shield is cylindrical and said cavity is cylindrical.

3. Lock assembly as recited in claim 1, wherein said shield extends downwardly from the front plate so that said opening faces downwardly.

4. Hasp for a padlock assembly, comprising:

(a) a back plate which is adapted to be secured to a flat surface, (b) a front plate which is hingedly connected to the back plate and having a slot for receiving the loop portion of a padlock staple, and (c) a tubular shield having an inner end which is fixed to one broad side of the front plate and which completely circumscribes said slot, said shield having an outer end which has an opening that is large enough to permit the insertion of a human hand, said tubular shield defining a cavity having a central longitudinal axis which extends at a substantial angle to the plane of said outwardly facing surface, said tubular shield being sufficiently long so that an adult human hand must be inserted beyond the wrist point to reach a padlock which is attached to the padlock staple.

5. Hasp as recited in claim 4, wherein said tubular shield is cylindrical and said cavity is cylindrical.

6. Lock assembly as recited in claim 4, wherein said shield extends downwardly from the front plate so that said opening faces downwardly.

7. Lock assembly as recited in claim 4, comprising a closure cap having a main body portion which is adapted to fit snugly into the opening of said shield, and a flange which extends laterally from said main body portion to maintain the cap at the opening.

8. Lock assembly as recited in claim 7, wherein said flange extends laterally beyond said shield to provide an overhanging lip for removal of the cap from the shield.

9. Lock assembly as recited in claim 4, wherein a second padlock receiving loop extends from said back plate, both of said loops being positioned to extend the slot in said front plate and for receiving the shackle of said padlock.

10. Lock assembly for securing first and second closure members, comprising:

(a) a face plate secured to one of said closure members, and having an outwardly facing flat surface, (b) a padlock receiving loop extending from the outer flat surface of said face plate, (c) a hasp having a back plate secured to the other of said closure members, and a front plate hingedly connected to the back plate for movement from an open position in which the front plate is clear of said one closure member to a closed position in which the front plate overlies said loop, said front plate having a slot for receiving the loop of said staple so that loop extends forwardly of the outwardly facing surface of the front plate when the front plate is in said closed position, said front plate having a lip which extends rearwardly about the periphery of the inwardly facing surface of said front plate so as to define an inwardly facing recess so that when said inwardly facing surface abuts said face plate, the face plate is enclosed within sait recess, (d) a padlock having a body portion, a shackle at one end of the body portion, and a keyhole at the other end of the body portion, said shackle being adapted to extend through the loop portion of said staple to secure the front plate of said hasp in said closed position, and (e) a tubular shield having an inner end which is fixed to said outwardly facing surface and which completely circumscribes said slot, said shield having an outer end which has an opening that is large enough to permit the insertion of a human hand, said tubular shield defining a cavity having a central longitudinal axis which extends at a substantial angle to the plane of the outwardly facing surface of said front plate.

11. Hasp for a padlock assembly, comprising:

(a) a back plate which is adapted to be secured to a flat surface of one of a pair of closure members, (b) a front plate which is hingedly connected to the back plate and having a slot for receiving the loop portion of a padlock staple, said front plate having a flat outwardly facing surface, a flat inwardly facing surface and an inwardly extending peripheral lip, said lip and said inwardly facing surface defining inwardly facing recess, so that when said front plate is pivotal against said back plate, said back plate is enclosed within said recess, and (c) a tubular shield having an inner end which is fixed to one broad side of the front plate and which completely circumscribes said slot, said shield having an outer end which has an opening that is large enough to permit the insertion of a human hand, said tubular shield defining a cavity having a central longitudinal axis which extends at a substantial angle to the plane of said outwardly facing surface.

* * * * *